US005923931A

United States Patent [19]

Kishimoto

[11] Patent Number: 5,923,931

[45] Date of Patent: Jul. 13, 1999

[54] SEALING MECHANISM AND CONTAINER EQUIPPED WITH THE SAME

[75] Inventor: Teruki Kishimoto, Osaka, Japan

[73] Assignee: Mita Industrial Co., Ltd., Osaka, Japan

[21] Appl. No.: 08/957,329

[22] Filed: Oct. 24, 1997

[30] Foreign Application Priority Data

Nov. 15, 1996 [JP] Japan ..... 8-318547

[51] Int. Cl.[6] ..... G03G 15/08; G03G 15/04; G03G 21/10

[52] U.S. Cl. ..... 399/256; 399/102; 399/119; 399/120; 399/358

[58] Field of Search ..... 399/119, 120, 399/252, 253, 254, 255, 256, 257, 258, 259, 260, 261, 262, 102–103, 105, 106

[56] References Cited

U.S. PATENT DOCUMENTS

| | | | |
|---|---|---|---|
| 5,515,143 | 5/1995 | Shiotani | 355/260 |
| 5,541,710 | 7/1996 | Stewart et al. . | |
| 5,659,859 | 6/1995 | Kikuta et al. | 399/256 |
| 5,715,502 | 7/1996 | Taniguchi et al. | 399/256 |

FOREIGN PATENT DOCUMENTS

586178 A2 3/1994 European Pat. Off. .

OTHER PUBLICATIONS

*Patent Abstracts of Japan*, Publ. No. 08145047, Publ. Date: Jun. 4, 1996, Appl. No. 06283075, Appl. Date: Nov. 17, 1994, Fujitsu Ltd., Ota Misako, Flange and Paddle Roller.

*Primary Examiner*—Richard Moses
*Assistant Examiner*—Shival Virmani
*Attorney, Agent, or Firm*—Beveridge, DeGrandi, Weilacher & Young,LLP

[57] ABSTRACT

A sealing mechanism for preventing the leakage of powder from between a through-hole and a rotary shaft which is supported between one side wall of a container containing said powder and the other side wall thereof and of which one end protrudes outwardly beyond said through-hole formed in said one side wall. A circular flange is formed on the rotary shaft, and a seal ring member is fitted between the circular flange of the rotary shaft and said one side wall. A to-be-engaged groove is formed in one end of the rotary shaft. An input gear made of a synthetic resin is fitted to the one end of the rotary shaft, and an engaging projection that engages with said to-be-engaged portion is formed in a portion of the input gear that is fitted to the rotary shaft.

2 Claims, 3 Drawing Sheets

SEALING MECHANISM AND CONTAINER EQUIPPED WITH THE SAME

FIELD OF THE INVENTION

The present invention relates to a sealing mechanism which is rotatably supported between one side wall and the other side wall of a container containing a powder, and prevents the leakage of the powder from between a through-hole and a rotary shaft of which the one end protrudes outwardly beyond the one side wall through the through-hole formed in the one side wall; and a toner cartridge equipped with the same.

DESCRIPTION OF THE PRIOR ART

In an electrostatic copying machine, electrostatic printer or electrostatic facsimile, an electrostatic latent image is formed on an electrostatic photosensitive material and is then developed into a toner image. A developing device for developing the electrostatic latent image into the toner image includes a developing housing for containing a so-called one-component developing agent comprising a toner only or a so-called two-component developing agent comprising the toner and carrier particles, a developing agent application means for conveying the developing agent contained in the developing housing to a developing zone and for applying it to the electrostatic photosensitive material, and a toner feeding means for feeding the toner to the developing housing. The toner feeding means usually includes a toner cartridge which is replaceably mounted. A typical toner cartridge includes a container which contains the toner and has a bottom wall, a side wall and other side wall, and further includes a toner discharge port formed in the bottom wall, and a conveying mechanism for conveying the toner present in the container toward the toner discharge port.

The conveying mechanism includes a rotary shaft which is rotatably supported between the one side wall and the other side wall and is so positioned as to pass above the toner discharge port, a pair of screw vanes formed on the rotary shaft and having the screw direction opposite to each other, and a plurality of discharge vanes. Each discharge vane is constituted by a plate piece which protrudes in the radial direction from the rotary shaft at equal angular intervals relative to each other, and is positioned above the toner discharge port. One screw vane extends between the one side wall of the container and the discharge vanes, and the other screw vane extends between the other side wall of the container and the discharge vanes. The rotary shaft, screw vanes and discharge vanes are usually molded as a unitary structure using a synthetic resin.

One end of the rotary shaft of the conveying mechanism passes through the through-hole formed in the one side wall of the container and protrudes outwardly beyond the one side wall, and an input gear is fitted to a protruded end thereof. When the toner cartridge is mounted on a predetermined position of the developing device, the input gear fitted to the rotary shaft of the conveying mechanism is drivably coupled to an electric motor via a transmission gear train. Therefore, the rotary shaft of the conveying mechanism, screw vanes and discharge vanes are rotated by the electric motor. The toner in the container is conveyed toward the discharge vanes from both ends of the container with the rotation of the screw vanes, permitted to fall (to be discharged) directly into the developing housing positioned under the toner cartridge from the toner discharge port that is opened, by the discharge vanes, or is permitted to fall onto a toner hopper positioned under the toner cartridge from the toner discharge port. The toner that has fallen onto the toner hopper is conveyed into the developing housing via another conveying mechanism arranged in the toner hopper. Thus, the toner is supplied from the toner cartridge to the developing device.

The toner cartridge is further provided with a sealing mechanism for preventing the leakage of powder from between the rotary shaft of the conveying mechanism and the through-hole formed in the one side wall. The sealing mechanism includes an annular flange formed on the rotary shaft with a gap maintained relative to the inner side surface of the one side wall, an elastic seal ring member fitted to the rotary shaft so as to be positioned in the above-mentioned gap, a to-be-engaged groove formed in the end portion of the rotary shaft, and a positioning member which is fitted into the to-be-engaged groove to define the position of the rotary shaft in the axial direction, so that the seal ring member is brought, by the flange, into pressed contact with the inner side surface of the one side wall. The seal ring member is constituted by a V-shaped synthetic rubber or a disk-like sponge. A typical positioning member is a stop ring called E-ring.

With the E-ring being fitted to the to-be-engaged groove of the rotary shaft, the seal ring member is compressed in the axial direction between the flange and the inner side surface of the one side wall, and the position of the rotary shaft is defined in the axial direction (i.e., the compressed dimension of the seal ring member in the axial direction is maintained) in a state where the E-ring is press-contacted to the outer side surface of the one side wall due to the elastic restoring force of the sealing ring member in the axial direction. In this state, the seal ring member is compressed in the axial direction between the flange of the rotary shaft and the inner side surface of the one side wall and is, hence, held in a state of being elastically deformed in the axial direction. Accordingly, the seal ring member is press-contacted, by the flange, onto the inner side surface of the one side wall, making it possible to prevent the leakage of the powder from between the rotary shaft and the through-hole formed in the one side wall.

However, the above-mentioned conventional toner cartridge involves the following problems that must be solved. That is, in the sealing mechanism as described above, a stop ring for defining the position of the rotary shaft in the axial direction is fitted, as a positioning member, to an end of the rotary shaft that protrudes outwardly beyond the one side wall. To the one end of the rotary shaft are further fitted the input gear adjacent to the stop ring and another stop ring for preventing the input gear from escaping in the axial direction. To fit another stop ring, another to-be-engaged groove is formed in one end of the rotary shaft. Therefore, the above-mentioned sealing mechanism includes an increased number of parts and becomes expensive. Moreover, the assembly operation is cumbersome and requires an extended period of time.

The above-mentioned problem is not limited to the toner cartridge only but commonly exists even in the devices of other forms, such as a developer equipped with a toner conveying mechanism and/or a toner stirrer mechanism, and devices equipped with a mechanism for conveying a powder other than the toner or the developing agent, stirrer mechanism, and other processing mechanisms.

SUMMARY OF THE INVENTION

A first object of the present invention is to provide a novel and improved sealing mechanism which includes a decreased number of parts, which can be produced at a reduced cost, and which can be easily assembled.

A second object of the present invention is to provide a novel and improved toner cartridge which includes a decreased number of parts, which can be produced at a reduced cost, and which can be easily assembled.

In order to accomplish the above-mentioned first object according to a first aspect of the present invention, there is provided a sealing mechanism for preventing the leakage of powder from between a through-hole and a rotary shaft which is rotatably supported between one side wall of a container containing said powder and the other side wall thereof and of which the one end protrudes outwardly beyond said one side wall passing through said through-hole formed in said one side wall, said sealing mechanism comprising an annular flange means disposed on said rotary shaft maintaining a gap relative to the inner side surface of said one side wall, an elastic seal ring member fitted to said rotary shaft so as to be positioned in said gap, a to-be-engaged groove means formed in said one end of said rotary shaft, and a positioning means fitted to said to-be-engaged groove means of said rotary shaft to define the position of said rotary shaft in the axial direction, so that said seal ring member is brought into pressed contact with said inner side surface of said one side wall; wherein said positioning means includes an input gear of a synthetic resin which is so fitted to said one end of said rotary shaft as to rotate together with said rotary shaft and an engaging portion formed on a portion where said input gear is fitted to said rotary shaft, and said engaging portion is brought into engagement with said to-be-engaged groove means of said rotary shaft in a state where said input gear is fitted to said rotary shaft.

According to the present invention, the positioning means is constituted by an engaging portion formed on the input gear. Unlike the conventional sealing mechanism, therefore, the present invention requires no stop ring for forming the positioning means. Moreover, the engaging portion formed on the input gear engages with the to-be-engaged groove means of the rotary shaft. Therefore, the input gear is prevented from escaping in the axial direction. Unlike the prior art, therefore, another stop ring is not required, either, for preventing the input gear from escaping in the axial direction. As a result, the sealing mechanism according to the present invention is constituted using a decreased number of parts and at a reduced cost. By simply mounting the input gear on the rotary shaft, furthermore, the compressed dimension of the seal ring member is secured, facilitating the assembly operation to conduct in a decreased period of time.

In order to accomplish the above-mentioned second object according to a second aspect of the present invention, there is provided a toner cartridge comprising a container for containing a toner and having a bottom wall, a side wall and another side wall, a toner discharge port formed in said bottom wall, a toner conveying mechanism for conveying the toner in said container toward said discharge port, and including a rotary shaft which is rotatably supported between said one side wall and said another side wall, and of which the one end protrudes outwardly beyond said one side wall through a through-hole formed in said side wall, and screw vanes formed on said rotary shaft, and a sealing mechanism for preventing the leakage of toner from between said rotary shaft and said through-hole, said sealing mechanism comprising an annular flange means disposed on said rotary shaft maintaining a gap relative to the inner side surface of said one side wall, an elastic seal ring member fitted to said rotary shaft so as to be positioned in said gap, a to-be-engaged groove means formed in said one end of said rotary shaft, and a positioning means fitted to said to-be-engaged groove means of said rotary shaft to define the position of said rotary shaft in the axial direction, so that said seal ring member is brought into pressed contact with said inner side surface of said one side wall; wherein said positioning means includes an input gear of a synthetic resin which is so fitted to said one end of said rotary shaft as to rotate together with said rotary shaft and an engaging portion formed on a portion where said input gear is fitted to said rotary shaft, and said engaging portion engages with said to-be-engaged groove means of said rotary shaft in a state where said input gear is fitted to said rotary shaft.

According to the present invention, the positioning means is constituted by an engaging portion formed on the input gear. Unlike the conventional sealing mechanism, therefore, the present invention requires no stop ring for forming the positioning means. Moreover, the engaging portion formed on the input gear engages with the to-be-engaged groove means of the rotary shaft. Therefore, the input gear is prevented from escaping in the axial direction. Unlike the prior art, therefore, another stop ring is not required, either, for preventing the input gear from escaping in the axial direction. As a result, the toner cartridge according to the present invention is constituted using a decreased number of parts and at a reduced cost. By simply mounting the input gear on the rotary shaft, furthermore, the compressed dimension of the seal ring member is secured, facilitating the assembly operation to conduct in a decreased period of time.

On an end of the input gear opposed to the outer surface of the one side wall is formed an annular boss that fits to the one end of the rotary shaft. In the boss are formed a pair of notches, spaced at a distance, in the circumferential direction to extend in the axial direction from the side of the one end toward the other end side. The engaging portion comprises a main engaging portion formed between the notches in the boss, and an engaging projection formed on one end of the main engaging projection to protrude from the inner periphery of the main engaging portion toward the inside in the radial direction. The main engaging portion can be elastically deformed in the radial direction.

According to the present invention, the engaging portion is easily and reliably formed together with the input gear as a unitary structure contributing to decreasing the cost.

DETAILED DESCRIPTION OF THE PREFERRED EMBODIMENTS

A preferred embodiment of a toner cartridge constituted according to the present invention will now be described in detail with reference to the accompanying drawings.

Figure 1:
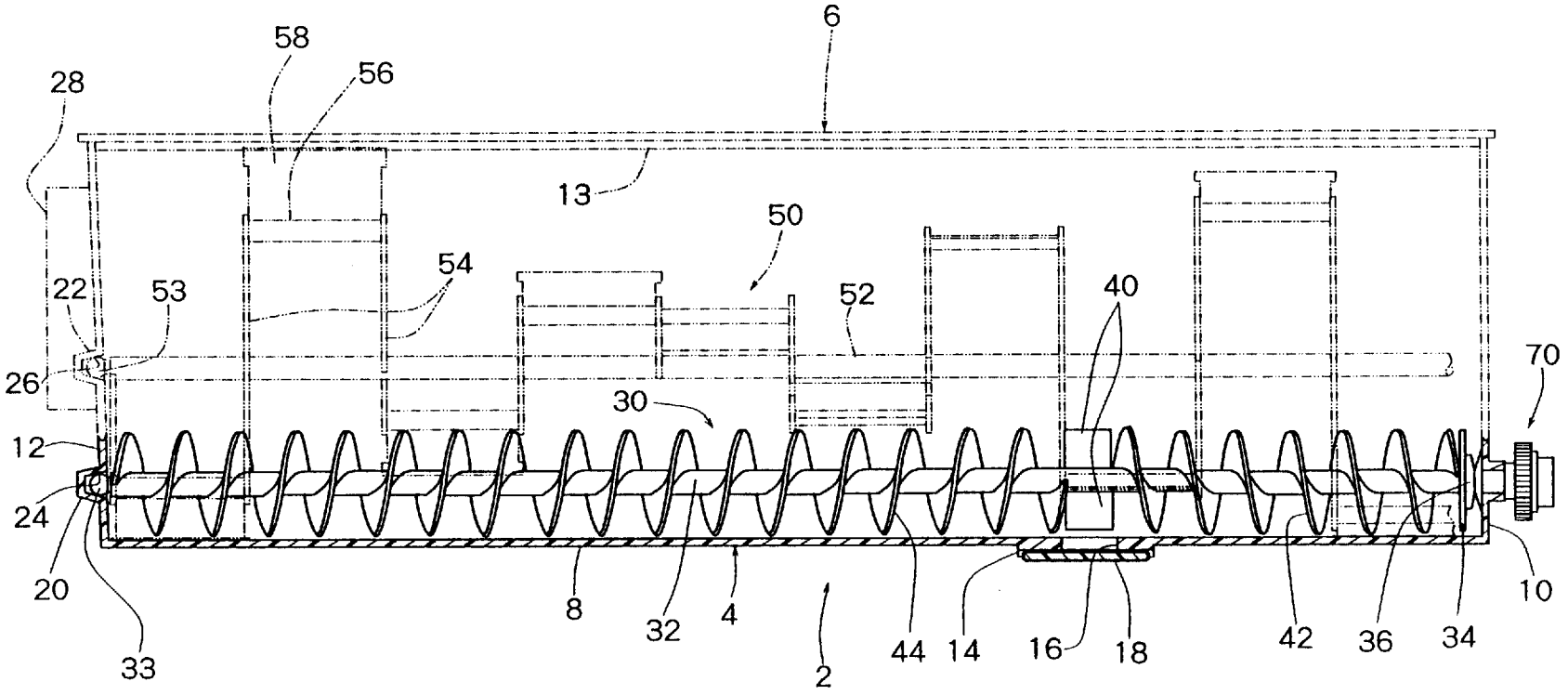
FIG. 1 is a schematic view illustrating, in cross section in the axial direction, a toner cartridge constituted according to a preferred embodiment of the present invention, in which the toner contained in a container is omitted.
Figure 2:
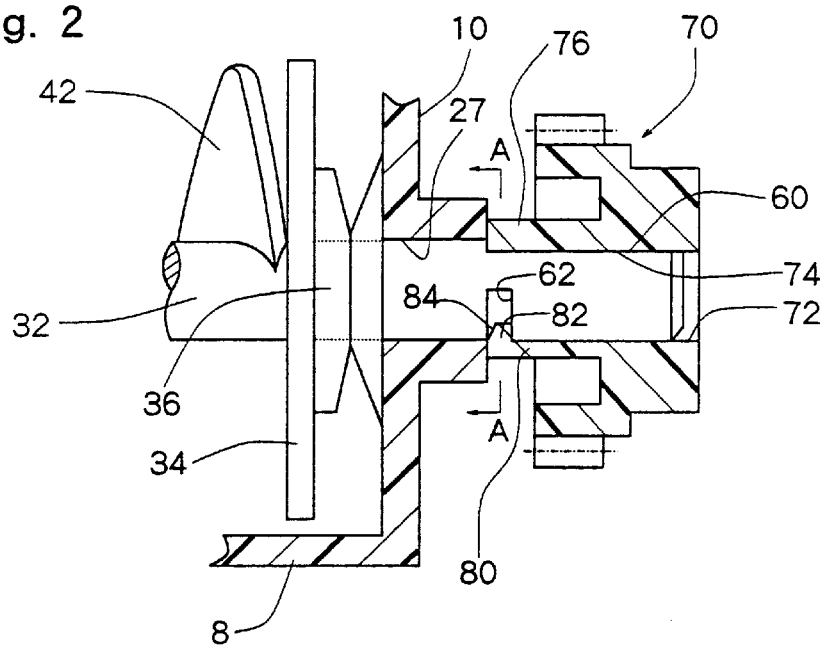
FIG. 2 is a sectional view of the container of the toner cartridge of FIG. 1 and illustrates a side wall portion on an enlarged scale.
Figure 3:
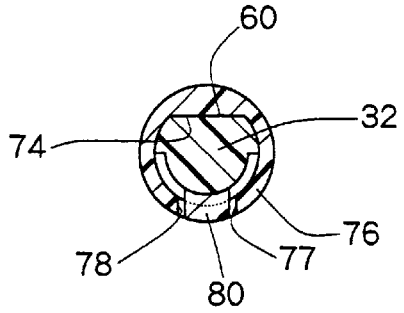
FIG. 3 is a sectional view along the line A—A in FIG. 2.
Figure 4:
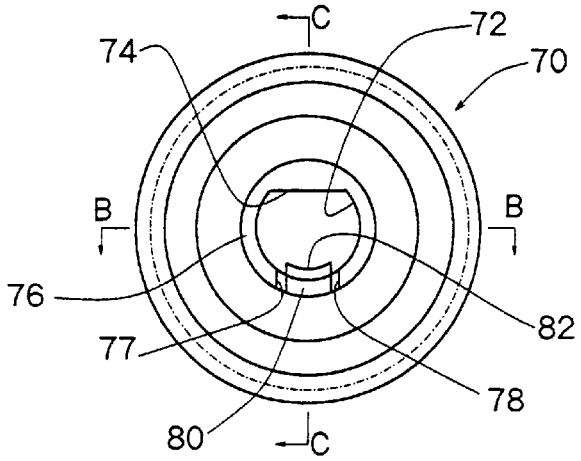
FIG. 4 is a view of when an input gear shown in FIG. 2 is seen from the left.

With reference to FIGS. 1 to 3, the illustrated toner cartridge is equipped with a container which as a whole is designated at 2 and is constituted by a main member 4 and a closure member 6. The main member 4 which can be formed of a suitable synthetic resin has the shape of a box with its upper surface opened. Though not clearly shown, the bottom wall surface of the main member is constituted by two portions that are arranged in parallel in a transverse cross-section, i.e., constituted by a front side portion and a back side portion shown in FIG. 1. The front side portion is defined by a relatively small arcuate portion, and the back side portion is defined by a linear central portion which extends substantially horizontally and by arcuate portions positioned on both sides thereof, and has a width larger than that of the front side portion. In addition to the above-mentioned two portions, the main member 4 includes a bottom wall 8, and one side wall 10 and other side wall 12 arranged at both ends in the lengthwise direction of the bottom wall 8 (the bottom wall 8 of FIG. 1 shows the front side portion in cross-section, and shows the bottom of the above-mentioned relatively small arcuate portion). The closure member 6 that can similarly be formed of a suitable synthetic resin has the shape of a flat plate, and has a protrusion 13 formed on the lower surface thereof in a shape to correspond to a rectangular opening formed in the upper surface of the main member 4. The closure member 6 of which the protrusion 13 is fitted into the main member 4 is positioned on the upper surface of the main member, and is secured to the main member 4 by a suitable method such as ultrasonic welding, so as to close the upper surface of the main member 4. The bottom wall 8 has a mouth portion 14 of a nearly rectangular shape that protrudes downwardly. A toner discharge port 16 is formed in the mouth portion 14. The toner discharge port 16 is nearly of a rectangular shape. The toner discharge port 16 is opened at its upper end in the upper surface of the arcuate portion and is opened at its lower end in the horizontal lower surface of the mouth portion 14. In the mouth portion 14 is mounted a shutter member 18 that slides between a closing position for closing the toner discharge port 16 and an open position for opening the toner discharge port 16. The shutter member 18 itself may be constituted in a well-known manner and is not described in detail in this specification.

On the other side wall 12 of the main member 4 of the container 2 are formed two protruded portions 20 and 22, and blind holes 24 and 26 are defined in the inside of the protruded portions 20 and 22. The blind holes 24 and 26 have a shape of a circular truncated cone of which the inner diameter gradually increases toward the inside. In the one side wall 10 are formed a through-hole 27 (see FIG. 2) and a through-hole that is not shown to correspond to the blind holes 24 and 26. The blind hole 24 and the through-hole 27 are positioned on a center line of curvature of the arcuate portion of the bottom wall 8. On the other hand, the blind hole 26 and the other through-hole that is not shown are positioned on an axis passing nearly the center of the upper space on the bottom wall in the back side portion of FIG. 1. In the other side wall 12 is further formed a relatively large circular opening (not shown). Through this opening, the container 2 is filled with the toner in a required amount. After the container is filled with the toner, a closure member 28 is fixed to the other side wall 12 by welding or adhesion, so as to close the opening.

With further reference to FIGS. 1 to 3, in the container 2 is disposed a toner conveying mechanism 30 positioned over the bottom wall 8. The toner conveying mechanism 30 has a rotary shaft 32. An end (right end) of the rotary shaft 32 is rotatably supported by the through-hole 27 in the one side wall 10 and protrudes outwardly beyond the one side wall 10. The other end (left end) 33 of the rotary shaft 32 is formed nearly in a spherical shape and has a diameter which lies between the smallest inner diameter and the largest inner diameter of the blind hole 24. A circular flange 34 which is an annular flange means is formed near the one end of the rotary shaft 32. A gap is formed between the circular flange 34 and the inner side surface of the one side wall 10, and a seal ring member 36 is fitted to the gap of the rotary shaft 32. The seal ring member 36 as a whole is of a V-shape and is made of a synthetic rubber having elasticity. The seal ring member 36 may be formed of a soft circular sponge. Referring to FIG. 1, the rotary shaft 32 can be rotatably mounted between the one side wall 10 and the other side wall 12 by inserting the other end 33 of a nearly spherical shape in the blind hole 20 formed in the other side wall 12 of the container 2, and by, while resiliently deforming the whole rotary shaft 32 to some extent, inserting the one end thereof in the through-hole 27 formed in the one side wall 10 of the container 2. Being mounted as described above, the rotary shaft 32 is positioned to pass over the toner discharge port 16.

As will be easily understood with reference to FIG. 1, the blind hole 20 has the shape of a circular truncated cone, and the other end 33 of the rotary shaft 32 has a nearly spherical shape. Therefore, the outer peripheral surface of the other end 33 of the rotary shaft 32 can come into line contact, instead of surface contact, with the inner peripheral surface of the blind hole 20 even though there may exist manufacturing error to some extent. Therefore, great rotational resistance is not produced by the frictional contact between the blind hole 20 and the other end 33 of the rotary shaft 32. As the one end of the rotary shaft 32 is inserted in the through-hole 27, the circular flange 34 is positioned close to the inner surface of the one side wall 10 owing to the sealing function that will be described later in detail. The seal ring member 36 is compressed to some extent between the circular flange 34 and the one side wall 10, and its right end is brought into pressed contact with the inner side surface of the one side wall 10. This prevents the toner from leaking out of the container 4 through the hole 27.

As described above, one end of the rotary shaft 32 outwardly protrudes penetrating through the one side wall 10, and an input gear 70 that will be described later in detail is fitted to the protruded end. When the toner cartridge is mounted on a predetermined position of the developing device (not shown), the input gear 70 is coupled to an electric motor (not shown) via a transmission gear train (not shown). When the electric motor is energized, the rotary shaft 32 is rotated in a predetermined direction. The toner conveying mechanism 30 is further equipped with a pair of discharge vanes 40 and a pair of screw vanes 42 and 44 formed on the rotary shaft 32. The discharge vanes 40 are formed of plate pieces that protrude in the radial direction from the rotary shaft at an equal angular distance from each other, and are positioned above the toner discharge port 16. The screw direction of the screw vane 42 is opposite to the screw direction of the screw vane 44. The screw vane 42 extends from the one side wall 10 up to the toner discharge port 16. The screw vane 44 extends from the other side wall 12 up to the toner discharge port 16.

The rotary shaft 32, circular flange 34, discharge vanes 40, and the screw vanes 42, 44 are molded as a unitary structure by using a suitable synthetic resin. This provides elastic deformation at the time of assembly operation in which the other end of the rotary shaft 32 is inserted in the blind hole 20 and the one end is inserted in the through-hole 27, facilitating the assembly operation.

When the rotary shaft 32 is rotated via the input gear 70, the screw vane 42 conveys the toner leftwardly toward the toner discharge port 16 in FIG. 1, and the screw vane 44 conveys the toner rightwardly toward the discharge port 16 in FIG. 1. The toner conveyed over the toner discharge port 16 is allowed to fall from the container 2 through the toner discharge port 16, and is supplied to the developing device (not shown) from the toner cartridge.

In the container 2 is further disposed a toner stirrer mechanism 50 at an upper position on the back side of the bottom wall. The toner stirrer mechanism 50 includes a rotary shaft 52. The rotary shaft 52, the one side wall 10 and the other side wall 12 for the rotary shaft 52 are supported substantially in the same manner as the rotary shaft 32, the one side wall 10 and the other side wall 12 for the rotary shaft 32 in the toner conveying mechanism 30. Therefore, the support constitution will be described only briefly. Though not illustrated, one end (right end) of the rotary shaft 52 is rotatably supported by another through-hole of the one side wall like the one end of the rotary shaft 32 of the conveying mechanism 30, and further protrudes outwardly beyond the one side wall 10. An input gear is mounted to one end of the rotary shaft 52 that protrudes outwardly beyond the one side wall 10. The other end (left end) 53 of the rotary shaft 52 is formed in a nearly spherical shape having a diameter which lies between a minimum inner diameter and a maximum inner diameter of the blind hole 26. A circular flange (not shown) is formed near the one end of the rotary shaft 52. A gap (not shown) is formed between the circular flange and the inner side surface of the one side wall 10, and a seal ring member (not shown) is fitted to the gap of the rotary shaft 52.

When the toner cartridge is mounted on a predetermined position of the developing device (not shown), the input gear of the rotary shaft 52 is coupled to an electric motor (not shown) via a transmission gear train (not shown). When the electric motor is energized, the rotary shaft 52 is rotated in a predetermined direction.

A plurality of arms 54 are arranged on the rotary shaft 52 of the toner stirrer mechanism 50 at equal distance intervals in the axial direction. Paddles 56 are arranged between the top ends of the pairs of arms 54 that are arranged at the same angular position and are neighboring to each other in the axial direction. The pairs of arms 54 as a whole are arranged at predetermined angular positions at intervals in the circumferential direction of the rotary shaft 52. The paddles 56 have a semicircular shape in lateral cross-section. Plate pieces 58 are attached to the paddles 56. The plate pieces 58 are made of a suitable synthetic resin film such as polyethylene terephthalate film. The plate pieces 58 extend from the base portions where they are secured, by a suitable method such as adhesion, to the flat surfaces of the paddles 56, in a direction to separate away from the rotary shaft 52 in parallel with the flat surfaces of the paddles 56. It is desired that the rotary shaft 52 of the toner stirrer mechanism 50, circular flange that is not shown, arms 54, and paddles 56 are molded as a unitary structure using a suitable synthetic resin.

When the toner stirrer mechanism 50 is rotated via the input gear, flat surfaces of the paddles 56 act upon the toner contained in the container 2 to stir it, and further convey the toner existing on the bottom wall to a portion where the toner conveying mechanism 30 is disposed. The plate pieces 58 attached to the paddles 56 slide along the linear central portion on the bottom wall of the container 2, inner surfaces of the arcuate portions on both sides thereof and inner surface of the rear wall (on the back side in FIG. 1) to prevent the toner from staying on the inner surfaces.

None of the illustrated container 2, toner conveying mechanism 30 and toner stirrer mechanism 50 constitute a novel feature of the present invention. Their details have been disclosed in the specification and drawings of U.S. patent application Ser. No. 08/659,572 filed on Jun. 6, 1996 and assigned to Mita Industrial Co., Ltd. and are not, hence, described in the specification and drawings of the present application.

Next, described below is a novel sealing mechanism for preventing the leakage of powder from between the rotary shaft 32 and the through-hole 27 of the one side wall 10. Referring chiefly to FIGS. 2 to 6, at an end of the rotary shaft 32 are formed a to-be-engaged notch 60 and a to-be-engaged groove 62 that constitutes a to-be-engaged groove means. The to-be-engaged notch 60 is formed by cutting away a portion of the peripheral surface of the rotary shaft 32 in an arcuate form on the lateral cross-section (see FIG. 3). The to-be-engaged notch 60 extends by a predetermined length in the axial direction from one end (right end) of the rotary shaft 32 toward the other end (left end) thereof as shown in FIG. 2. The upper surface of the to-be-engaged notch 60 is flat and is in parallel with the axis of the rotary shaft 32. At a portion on the other end side (left end side) of the to-be-engaged notch 60, the to-be-engaged groove 62 is formed on the side opposite to the to-be-engaged notch 60 in the radial direction and extends over one-half the circumference of the rotary shaft 32 arcuately in the circumferential direction.

Figure 5:
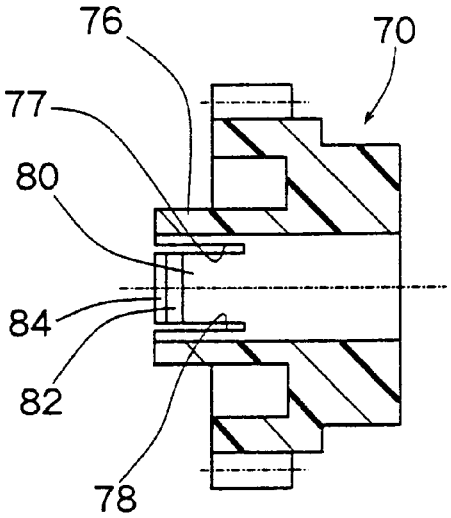
FIG. 5 is a sectional view along the line B—B in FIG. 4.
Figure 6:
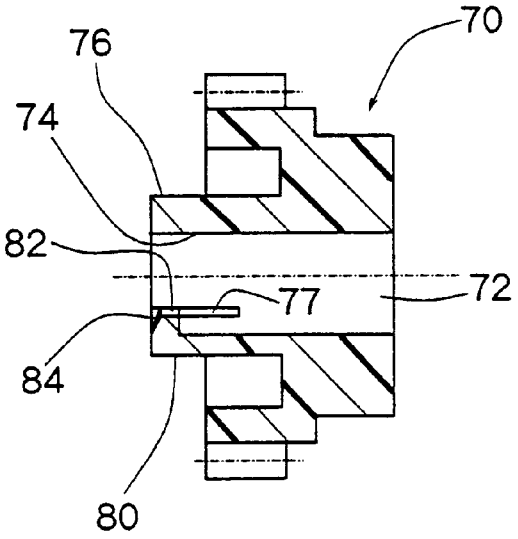
FIG. 6 is a sectional view along the line C—C in FIG. 4.

A through hole 72 is formed in the axis center of the input gear 70 that is integrally molded by using a suitable synthetic resin, extending from one end (left end in FIGS. 5 and 6) toward the other end (right end in FIGS. 5 and 6). On a portion on the inner peripheral surface of the through hole 72 is formed an engaging protuberance 74 of a shape corresponding to the to-be-engaged notch 60 of the rotary shaft 32. As shown in FIGS. 2 and 6, the engaging protuberance 74 extends from one end toward the other end of the input gear 70. The inner surface of the engaging protuberance 74 is flat and is in parallel with the axis of the input gear 70.

An annular boss 76 is formed on one end of the input gear 70. In the boss 76, a pair of notches 77 and 78 are formed, spaced at a distance, in the circumferential direction of the boss 76 and extend straight in the axial direction by a predetermined length from one end thereof toward the other end thereof. The notches 77 and 78 have a predetermined distance in the circumferential direction. A main engaging portion 80 having an arcuate shape in cross section that intersecting the axis of the input gear 70 at right angles is formed in a portion of the boss 76 sandwiched by the notches 77 and 78 in the circumferential direction. An engaging projection 82 is formed on an end of the main engaging portion 80 inwardly protruding in the radial direction from the inner peripheral portion of the main engaging portion 80. As will be easily understood from FIG. 2, the engaging projection 82 has a nearly rectangular shape in cross section in the axial direction, and a tilted surface 84 is formed between one end and the inner peripheral portion thereof. It is important that the main engaging portion 80 is allowed to undergo an elastic deformation in the radial direction.

The main engaging portion 80 and the engaging projection 82 constitute an engaging portion relative to the rotary shaft 32, and the input gear 70 and the engaging portion constitute a positioning means for the rotary shaft 32. The circular flange 34, seal ring member 36 and the positioning means constitute a sealing mechanism.

In a state where the rotary shaft 32 is rotatably supported between the one side wall 10 and the other side wall 12, an input gear 70 is fitted to one end that is protruding outwardly beyond the one side wall 10. That is, the through-hole 72 of the input gear 70 is fitted to one end of the rotary shaft 32 and is, then, pushed from one end toward the other end, so that the engaging projection 82 of the input gear 70 is brought into engagement with the to-be-engaged groove 62 of the rotary shaft 32. The input gear 70 is so mounted as will not rotate relative to the rotary shaft 32 and as will not be allowed to move in the axial direction.

With the input gear 70 being fitted to the rotary shaft 32 as described above, furthermore, the seal ring member 36 is compressed in the axial direction (toward the right in FIG. 2) between the circular flange 34 and the inner side surface of the one side wall 10. Due to the elastic restoring force in the axial direction (toward the left in FIG. 2), the rotary shaft 32 is defined for its position in the axial direction (i.e., compressed dimension of the seal ring member 36 in the axial direction is maintained) in a state where the end surface of the input gear 70, i.e., the end surface of the boss 76 is compressed onto the outer surface of the one side wall 10. In this state, the seal ring member 36 is compressed in the axial direction between the circular flange 34 of the rotary shaft 32 and the inner surface of the one side wall 10, and is, hence, maintained in a state of being elastically deformed in the axial direction. As a result, the seal ring member 36 is press-contacted by the circular flange 34 onto the inner side surface of the one side wall 10, and the leakage of the toner is prevented from between the rotary shaft 32 and the through-hole 27 formed in the one side wall 10.

As described above, the through hole 72 of the input gear 70 is fitted to one end of the rotary shaft 32 and is, then, pushed from one end toward the other end. In this case, the main engaging portion 80 is forcibly deflected outwardly in the radial direction due to its elasticity, and is moved in a state where the engaging projection 82 is press-contacted to the peripheral surface of the rotary shaft 32. When the engaging projection 82 is brought into match with the groove 62 in the rotary shaft 32, it is caused to move inwardly in the radial direction due to the elastic restoring force of the main engaging portion 80 and is brought into engagement with the to-be-engaged groove 62. Such an assembly operation is easily executed through one-touch operation. The tilted surface 84 at the end of the engaging projection 82 works to smoothly carry out the above-mentioned engaging operation.

Though not illustrated, a sealing mechanism which is substantially the same as the one described above is arranged between the rotary shaft 52 and the one side wall 10 in the toner stirrer mechanism 50 in the toner cartridge 2, to exhibit the same function and effect.

In the foregoing was described a preferred embodiment of the toner cartridge constituted according to the present invention with reference to the accompanying drawings. It should, however, be noted that the present invention is in no way limited to the above-mentioned embodiment only but can be modified or changed in a variety of ways without departing from the scope of the present invention. For example, although the sealing mechanism of the present invention was described in detail with reference to the embodiment in which it was applied to the toner cartridge, the sealing mechanism of the present invention can be applied to the devices of other forms such as a developer equipped with a toner conveying mechanism and/or a toner stirrer mechanism and devices equipped with a mechanism for conveying a powder other than the toner or the developing agent, stirrer mechanism, and other processing mechanisms.

What I claim is:

1. A sealing mechanism for preventing the leakage of powder from between a through-hole and a rotary shaft which is rotatably supported between one side wall of a container containing said powder and the other side wall thereof and of which one end protrudes outwardly beyond said one side wall passing through said through-hole formed in said one side wall, said sealing mechanism comprising an annular flange means disposed on said rotary shaft maintaining a gap relative to the inner side surface of said one side wall, an elastic seal ring member fitted to said rotary shaft so as to be positioned in said gap, a to-be-engaged groove means formed in said one end of said rotary shaft, and a positioning means fitted to said to-be-engaged groove means of said rotary shaft to define the position of said rotary shaft in the axial direction, so that said seal ring member is brought into pressed contract with said inner side surface of said one side wall; wherein said positioning means includes an input gear of a synthetic resin which is so fitted to said one end of said rotary shaft as to rotate together with said rotary shaft and an engaging portion formed on a portion where said input gear is fitted to said rotary shaft, and said engaging portion is brought into engagement with said to-be-engaged groove means of said rotary shaft in a state where said input gear is fitted to said rotary shaft, wherein an annular boss is formed in said input gear on the side of an end thereof opposed to the outer surface of said one side wall to engage with said one end of said rotary shaft, a pair of notches are formed in said boss, spaced at a distance, in the circumferential direction of said boss to extend in the axial direction from the side of one end thereof toward the side of the other end thereof, said engaging portion is constituted by a main engaging portion formed between said notches in said boss and an engaging projection formed on the side of said one end of said main engaging portion to inwardly protrude in the radial direction from the inner peripheral portion of said main engaging portion, and said main engaging portion can undergo elastic deformation in the radial direction.

2. A toner cartridge comprising a container for containing a toner and having a bottom wall, a side wall and another side wall, a toner discharge port formed in said bottom wall, a toner conveying mechanism for conveying the toner in said container toward said discharge port, and including a rotary shaft which is rotatably supported between said one side wall and said another side wall, and of which one end protrudes outwardly beyond said one side wall through a through-hole formed in said side wall, and screw vanes formed on said rotary shaft, and a sealing mechanism for preventing the leakage of toner from between said rotary shaft and said through-hole, said sealing mechanism comprising an annular flange means disposed on said rotary shaft maintaining a gap relative to the inner side surface of said one side wall, an elastic seal ring member fitted to said rotary shaft so as to be positioned in said gap, a to-be-engaged groove means formed in said one end of said rotary shaft, and a positioning means fitted to said to-be-engaged groove means of said rotary shaft to define the position of said rotary shaft in the axial direction, so that said seal ring member is brought into pressed contact with said inner side surface of said one side wall; wherein said positioning means includes an input gear of a synthetic resin which is so fitted to said one end of said rotary shaft as to rotate together with said rotary shaft and an engaging portion formed on a portion where said input gear is fitted to said rotary shaft, and said engaging portion is brought into engagement with said to-be-engaged groove means of said rotary shaft in a state where said input gear is fitted to said rotary shaft, wherein an annular boss is formed in said input gear on the side of an end thereof opposed to the outer surface of said one side wall to engage with said one end of said rotary shaft, a pair of notches are formed in said boss, spaced at a distance, in the circumferential direction of said boss to extend in the axial direction from the side of one end thereof toward the side of the other end thereof, said engaging portion is constituted by a main engaging portion formed between said notches in said boss and an engaging projection formed on the side of said one end of said main engaging portion to inwardly protrude in the radial direction from the inner peripheral portion of said main engaging portion, and said main engaging portion can undergo elastic deformation in the radial direction.

* * * * *